US007891138B2

(12) United States Patent
Ottino

(10) Patent No.: US 7,891,138 B2
(45) Date of Patent: Feb. 22, 2011

(54) FUNCTIONAL UNIT FOR A DOOR OF A MOTOR VEHICLE

(75) Inventor: Franco Giovanni Ottino, Giuliano Terme (IT)

(73) Assignee: Intier Automotive Closures S.p.A., Cascine Vica Rivoli (IT)

( * ) Notice: Subject to any disclaimer, the term of this patent is extended or adjusted under 35 U.S.C. 154(b) by 892 days.

(21) Appl. No.: 10/561,333

(22) PCT Filed: Jun. 16, 2004

(86) PCT No.: PCT/EP2004/051136

§ 371 (c)(1),
(2), (4) Date: May 1, 2006

(87) PCT Pub. No.: WO2004/111371

PCT Pub. Date: Dec. 23, 2004

(65) Prior Publication Data

US 2006/0254144 A1 Nov. 16, 2006

(30) Foreign Application Priority Data

Jun. 17, 2003 (IT) ..... TO2003A0456

(51) Int. Cl.
*E06B 3/00* (2006.01)

(52) U.S. Cl. ..... 49/503; 49/141; 296/146.5

(58) Field of Classification Search ..... 49/348, 49/349, 502, 503, 141; 296/146.5, 146.7
See application file for complete search history.

(56) References Cited

U.S. PATENT DOCUMENTS

| | | | | |
|---|---|---|---|---|
| 4,381,625 | A | | 5/1983 | Andrei-Alexandru et al. |
| 4,478,004 | A | | 10/1984 | Andrei-alexandru et al. |
| 5,634,677 | A | * | 6/1997 | Buscher et al. ..... 292/216 |
| 5,694,812 | A | * | 12/1997 | Maue et al. ..... 74/471 R |
| 5,844,382 | A | * | 12/1998 | Dan ..... 318/10 |
| 5,902,004 | A | * | 5/1999 | Waltz et al. ..... 296/146.9 |
| 5,920,158 | A | | 7/1999 | Miller et al. |
| 6,075,298 | A | | 6/2000 | Maue et al. |

FOREIGN PATENT DOCUMENTS

| | | |
|---|---|---|
| DE | 195 26 451 | 7/1995 |
| EP | 1 149 969 | 4/2001 |
| WO | WO 2004/055310 | 7/2004 |

* cited by examiner

*Primary Examiner*—Jerry Redman
(74) *Attorney, Agent, or Firm*—Clark Hill, P.L.C.

(57) ABSTRACT

Described herein is a functional unit (1) for a door (2) of a motor vehicle, provided with a lock (3) and a window-regulator device (5); the lock (3) comprises a closing mechanism (20), designed to couple in a releasable way with a lock striker (4) for bringing about closing of the door (2), and an actuating mechanism (21), for controlling release of the closing mechanism (20) by the lock striker (4) and bringing about opening of the door (2); the window-regulator device (5) comprises an electrically operated actuator (22) for raising or lowering a window (7) of the door (2). The unit (1) is further provided with coupling means (56), which can be selectively activated for coupling together the actuator (22) and the actuating mechanism (21) so as to enable opening of the door (2) via the actuator (22) itself.

5 Claims, 5 Drawing Sheets

FUNCTIONAL UNIT FOR A DOOR OF A MOTOR VEHICLE

TECHNICAL FIELD

The present invention relates to a functional unit for a door of a motor vehicle, basically comprising a lock and a window-regulator device.

BACKGROUND ART

As is known, doors of motor vehicles generally comprise a frame-like top portion, which defines a window opening closed by a mobile window, when the latter is raised, and a bottom box-type portion formed by an outer panel and by an inner panel, which are joined at one end by a head edge and together define a compartment, in which there are commonly housed the window, when the latter is lowered, and the various components fixed to the panels themselves, among which, for example, the lock, the key unit, the internal and external handles, the various members for connection between the aforesaid components, and the window-regulator device.

Conveniently, the components mentioned above are inserted in the compartment of the door through one or more openings made in the inner panel and are variously assembled together and fixed to the panels themselves.

Said operations are relatively long and problematical and hence entail long stoppage times of the doors in various stations along the assembly line, with relatively high costs linked thereto.

There is therefore felt, in the sector, the need to create pre-assembled functional units, which include some of the aforementioned components so as to enable a drastic reduction in the times of assembly of the doors.

Parallel to this, there is an increasingly widespread use of electrically operated actuators for controlling window-regulator devices and for providing the main functions associated to modern locks.

In particular, as is known, a lock for a motor vehicle typically comprises a closing mechanism, designed to couple in a releasable way with a fixed lock striker for bringing about closing of the door, and an actuation assembly, which is designed to control release of the closing mechanism from the lock striker and can be connected to the manual-control elements associated to the door of the motor vehicle, such as, for example, the internal and external handles and the key unit.

More precisely, the actuation assembly in general comprises an internal control lever connected to the internal handle of the door, an external control lever connected to the external handle of the door, and a safety linkage, which can be actuated by means of a key from the outside of the motor vehicle and by means of a knob and/or the internal handle to disable or enable opening of the door by means of the external handle so rendering the external control lever non-effective or effective, respectively (external safety function activated or deactivated).

Traditional locks are moreover generally provided with a linkage for disabling/enabling opening from inside the motor vehicle (internal safety function or dead-lock function activated or deactivated).

The aforementioned safety functions and the functions for opening and closing lock are ever more frequently obtained with the aid of respective electrically operated actuators, which are, in turn, controlled via microswitches and/or signalling devices.

It is therefore evident that, as the number of actuators used increases, this gives rise to an excessive complication of the corresponding locks both from the standpoint of the electronic control and from the mechanical standpoint, with an increase in the overall costs, dimensions, weight, and with a possible onset of problems of reliability. These drawbacks tend to be further amplified in the case where pre-assembled units are provided, which include not only the locks of the type described above but also other electrically controlled components.

DISCLOSURE OF INVENTION

The purpose of the present invention is to provide a functional unit for a door of a motor vehicle, which will enable the drawbacks specified above to be overcome in a simple and economically advantageous way.

According to the present invention, a functional unit for a door of a motor vehicle is provided which comprises a lock and a window-regulator device, said lock comprising a closing mechanism designed to couple in a releasable way with a lock striker for bringing about closing of said door (2), and an actuating mechanism for controlling release of said closing mechanism by said lock striker and bringing about opening of said door, said window-regulator device comprising an electrically operated actuator for raising and lowering a window of said door, said functional unit being characterized in that it further comprises coupling means, which can be selectively activated for coupling together said actuator and said actuating mechanism so as to enable opening of said door by means of the actuator itself.

BRIEF DESCRIPTION OF THE DRAWINGS

For a better understanding of the present invention, two preferred embodiments are described in what follows, purely by way of non-limiting examples and with reference to the annexed drawings, in which.

BEST MODE FOR CARRYING OUT OF THE INVENTION

Figure 1:
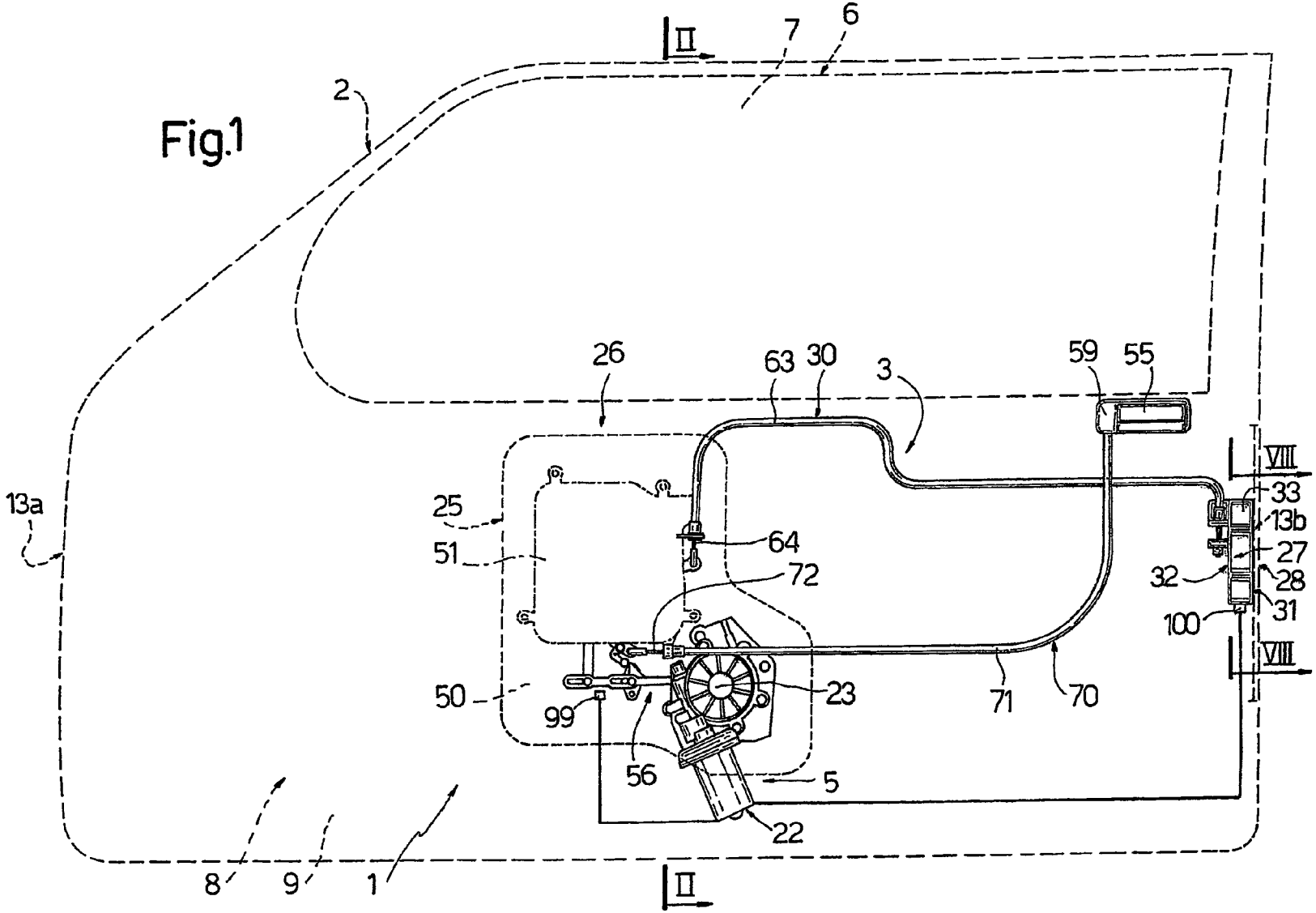
FIG. 1 is a schematic side elevation of a door of a motor vehicle provided with a functional unit according to the present invention, formed basically by a lock and a window-regulator device.
Figure 2:
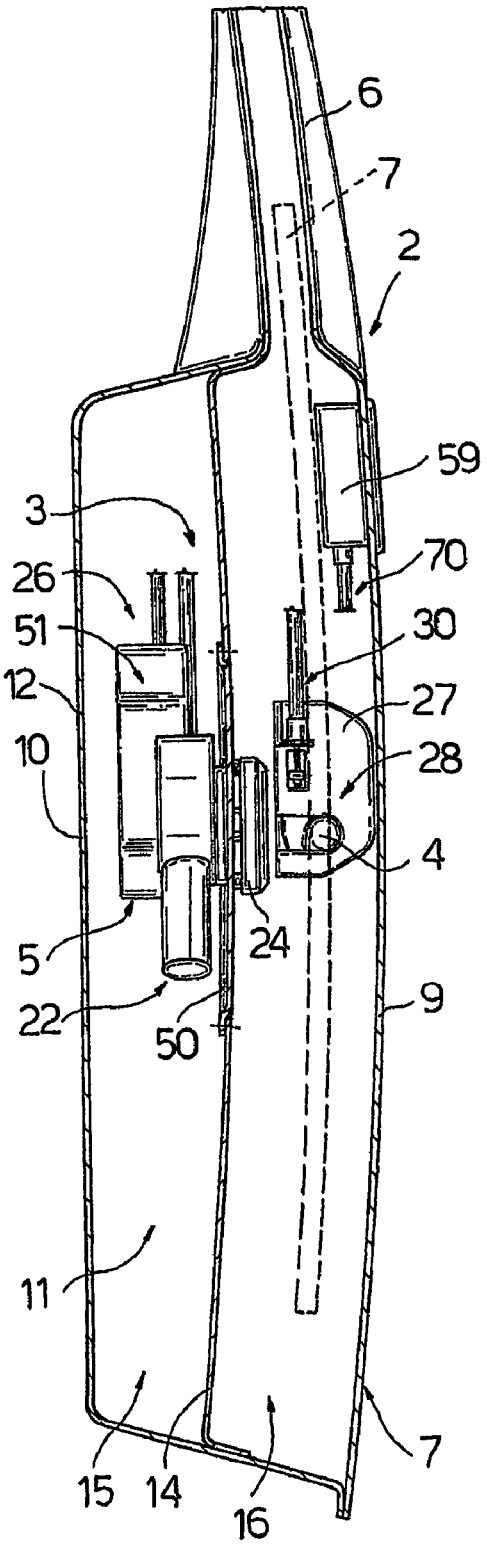
FIG. 2 is a cross-sectional view at an enlarged scale according to the line II-II of FIG. 1, with parts removed for reasons of clarity.

With reference to FIGS. 1 and 2, designated as a whole by 1 is a functional unit according to the present invention for a door 2 of a motor vehicle (not illustrated), in particular for a door of the type designed to be hinged to the frame of the motor vehicle itself.

The functional unit 1 is basically formed by a lock 3, which is designed to interact in a known way with a lock striker 4 fixed to an upright of the door 1, and a window-regulator device 5.

It is pointed out that, in the ensuing description, the functional unit 2 and, along with it, the lock 3 and the window-regulator device 5 are described only as far as is necessary to enable understanding of the present invention. In particular, the description of the lock 3 will be limited to the opening and closing functions. Consequently, the further functions normally present in traditional locks, such as, for example, the functions for disabling opening from inside and from outside the motor vehicle (commonly referred to as safety function and dead-lock function), and the lever mechanisms associated thereto are not treated in the present description, without this implying that their use in the lock 3 is to be considered excluded.

Likewise, the description of the window-regulator device 5, which is in itself known and may, for example, be of the cable type described in the international patent application n. WO 02/088502 A1, will be limited just to the control part.

With reference to FIGS. 1 and 2, the door 2 comprises, in a known way, a frame-like top portion 6, which defines a window opening closed by a mobile window 7, when the latter is raised, and a box-type bottom portion 8, defined by an outer panel 9 and an inner panel 10 forming together a compartment 11, in which there are housed the window 7, when the latter is lowered, and the functional unit 2. For this purpose, the inner panel 10 has an opening (not visible in the annexed figures) for the introduction of the functional unit 2 within the compartment 11.

In greater detail, the inner panel 10 has a main portion 12, which is basically plane and parallel to the outer panel 9, and opposite edges having side ends 13*a*, 13*b*, which project orthogonally in cantilever fashion from the opposite side ends of the main portion 12 itself, are joined to the outer panel 9 and define, respectively, the hinging side and the opening side of the door 2.

The bottom portion 8 of the door 2 moreover has waterproof internal diaphragm 14 (see FIG. 2), which is set between the panels 9 and 10 and divides the compartment 11 into a dry region 15, delimited by the inner panel 10, and a wet region 16, i.e., a region which is subject to water and to atmospheric moisture, said region being delimited by the outer panel 9.

With reference to FIG. 1 and to FIGS. 3 to 8, the lock 3 basically comprises a closing mechanism 20 (see FIG. 8), in itself known, designed to couple in a releasable way with the lock striker 4 for bringing about closing of the door 2, and an actuating mechanism 21 (see FIGS. 3 to 7) for controlling release of the closing mechanism 20 from the lock striker 4 and bringing about opening of the door 2.

The window-regulator device 5 basically comprises an electrically operated actuator 22, in the case in point a motor reducer, of a known type, having an output shaft 23, angularly fixed to which is a roller 24 for winding a cable (not illustrated) for raising and lowering the window 7, according to what is described and illustrated in the international patent application WO 02/088502 A1 with particular reference to FIGS. 1 and 2 of said patent application.

More precisely, according to what is illustrated in the cited figures of said patent application, the cable for raising and lowering the window 7 is designed to be wound, not only on the roller 24, but also around a pair of fixed-axis pulleys set on opposite sides of the roller 24 itself, and is fixed to a plate, which is coupled to the window 7 and can slide along a corresponding vertical guide.

Advantageously, the actuating mechanism 21 of the lock 3 and the actuator 22 of the window-regulator device 5 are mounted on a single supporting body 25, which is, in turn, fixed to the diaphragm 14 of the door 2, and define, with the supporting body 25 itself, a control module 26 for controlling the functional unit 1.

The closing mechanism 20 is instead mounted on a supporting body 27, which is distinct from the supporting body 25 and is fixed to the bottom portion 8 of the door 2 in a remote position with respect to the supporting body 25 itself. More precisely, the closing mechanism 20 defines, together with the supporting body 27, a closing module 28 for the functional unit 1 and is operatively connected to the actuating mechanism 21 by means of a transmission 30 with Bowden-type flexible cable. Alternatively, the remote connection between the closing mechanism 20 and the actuating mechanism 21 could be provided by means of a rigid transmission, for example a rod or a tie rod.

In order to interact with the lock striker 4, the closing module 28 is necessarily housed within the wet region 16 of the compartment 11 of the door 2. The control module 26 may, instead, be located in the desired position within the compartment 11 of the door 2 and preferably, within the dry region 15 of the compartment 11 itself. In the case in point illustrated, the supporting body 25, the actuating mechanism 21 of the lock 3, and the actuator 22 of the window-regulator device 5 are located in the dry region 15, whilst, as will be described in greater detail in what follows, the shaft 23 traverses in a fluid-tight way the supporting body 25 and the diaphragm 14 so as to set the roller 24 in the wet region 16 of the compartment 11 in which the window 7 is raised and lowered.

Figure 8:
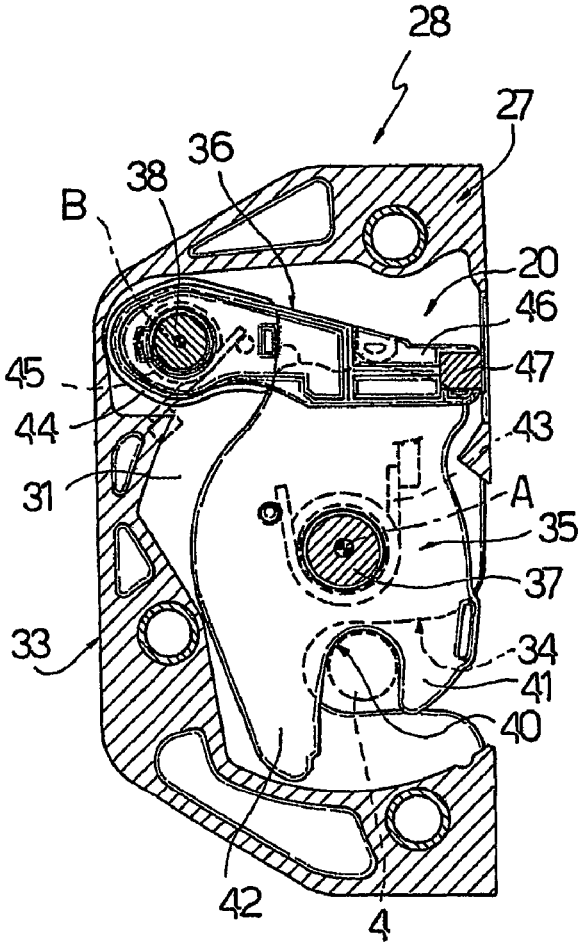
FIG. 8 is a cross section at an enlarged scale according to the line VIII-VIII of FIG. 1.

With reference to FIGS. 1, 2 and 8, the supporting body 27 has a prismatic box-type shape and defines internally a compartment for housing the closing mechanism 20.

Preferably, the supporting body 27 has opposite end walls 31, 32 of a polygonal shape joined peripherally together by a side edge 33 having a small thickness as compared to the dimensions of the walls 31, 32 themselves.

The supporting body 27 is fixed with its own end wall 31 to the end edge 13*b* of the inner panel 10 of the door 2 and with a portion of its own side edge 33 to the main portion 12 of the panel 10 itself.

The supporting body 27 has, moreover, a C-shaped side opening 34 for the introduction of the lock striker 4, which extends in part along the end wall 31 and in part along a portion of the side edge 33. The opening 34 is moreover set in an area corresponding to an angular opening (not visible in the annexed figures) made in the bottom portion 8 of the door 2 in an area corresponding to the sharp-edge area defined between the end edge 13*b* and the main portion 12 of the inner panel 10.

The closing mechanism 20 (see FIG. 8) comprises, in a known way, a fork 35 and a dog or catch 36, which are hinged about respective pins 37, 38 extending between the end walls 31, 32, are rigidly supported by the latter, and have respective axes A, B parallel to one another and orthogonal to the walls 31, 32 themselves.

The fork 35 is formed by a shaped plate, which is hinged in an area corresponding to an intermediate portion thereof around the pin 37 and has a C-shaped peripheral seat 40 designed to house the lock striker 4 and delimited laterally by a pair of teeth 41, 42.

The fork 35 is subject to the action of return of a spring 43 wound around the pin 37 and constrained to the fork 35 itself and to a portion of the supporting body 27; in particular, the fork 35 is pushed by the spring 43 towards an opening position (not illustrated), in which it is set laterally bearing upon its own tooth 41 against the side edge of the opening 34 and has its own seat 40 substantially facing in the same direction as the opening 34 itself so as to enable engagement and disengagement of the lock striker 4.

Under the thrust of the lock striker 4 and upon slamming of the door 2, the fork 35 can turn about the axis A from the opening position to a closing position, in which the lock striker 4 is blocked in the seat 40, and the tooth 41 intercepts in a known way the opening 34, so preventing exit thereof.

The dog 36 is hinged to the pin 38 and comprises, in the case in point illustrated, an engagement portion 44, which is substantially coplanar to the fork 35 and is designed to couple by snap-action, via an L-shaped end sharp edge thereof, with a peripheral edge of the fork 35 itself so as to block it in a releasable way in the closing position, and an actuating arm 46, which is constrained to the transmission 30 for receiving opening forces from the actuating mechanism 21.

The dog 36 is pushed in a known way towards the peripheral edge of the fork 35 by a spring 45 wound around the pin 38 and constrained to the dog 36 itself and to a portion of the supporting body 27.

The actuating arm 46 has a shape elongated in a direction transverse to the axis B of the pin 38, is set on top of the engagement portion 44, and projects with respect to the latter.

The actuating arm 46 carries, in cantilever fashion, in an area corresponding to an end thereof opposite to the end hinged to the pin 38, a projection 47, which protrudes outside of the supporting body 27 through an opening (not illustrated) of the end wall 32 and is constrained in a known way to the transmission 30.

With reference to FIGS. 1, 2, 3 and 7, the supporting body 25 comprises a plate element 50, which is designed to be fixed to the diaphragm 14 on the side facing the inside of the dry region 15 of the compartment 11, and on which there are mounted the actuator 22 of the window-regulator device 5 and a box-type element 51 (illustrated schematically) which houses internally the actuating mechanism 21 of the lock 3.

Figure 7:
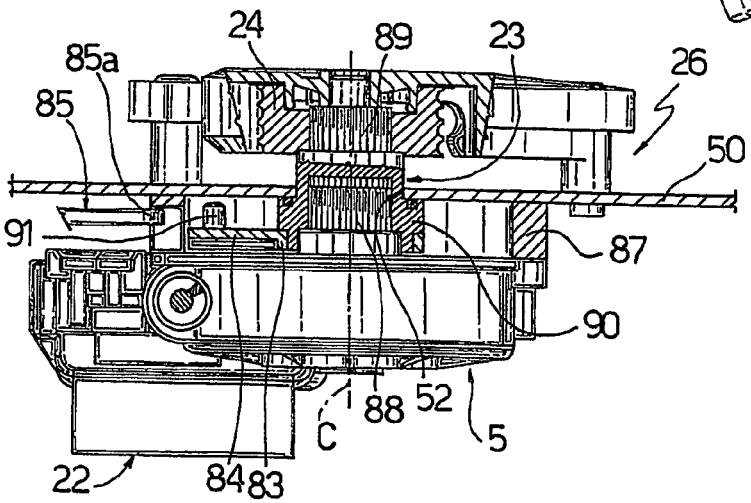
FIG. 7 is a cross section according to the line VII-VII of FIG. 3.

More in particular, as illustrated in FIG. 7, the plate element 50 supports, on one side, the actuator 22 and the box-type element 51 and, on the opposite side, the roller 24 for winding of the cable for raising and lowering the window 7. The plate element 50 is fixed to the diaphragm 14 on the side on which the roller 24 is mounted and is moreover provided with a through hole 52 of axis C co-axially engaged in a fluid-tight way by the shaft 23.

As may be seen in FIGS. 3 to 6 and as will be described in detail in what follows, the actuating mechanism 21 comprises a plurality of levers, some of which are not illustrated in so far as they are not necessary for an understanding of the present invention, the said levers extending on parallel planes to the plate element 50 and hinged to respective pins which are fixed and orthogonal to the plate element 50 itself.

In particular, the actuating mechanism 21 basically comprises a rocker-type opening lever 53, which is constrained, on one side, to the actuating arm 46 of the dog 36 and is designed to receive, on the opposite side, opening forces, and a control lever 54, which is connected to an external handle 55 (see FIGS. 1 and 2) of the door 2 and is designed to control actuation of the opening lever 53 to bring about, by means of the transmission 30, uncoupling of the dog 36 from the fork 35 and opening of the door 2.

According to an important characteristic of the present invention, the opening lever 53 is designed to be controlled by the actuator 22 of the window-regulator device 5 through a transmission lever mechanism 56, which can be selectively activated by the control lever 54 and is set between the shaft 23 and the opening lever 53 itself.

With particular reference to FIGS. 3 to 6, the opening lever 53 is hinged in an intermediate position to a pin 57, which is fixed to the box-type element 51 and has an axis D orthogonal to the plate element 50 and parallel to the axis C.

Figure 3:
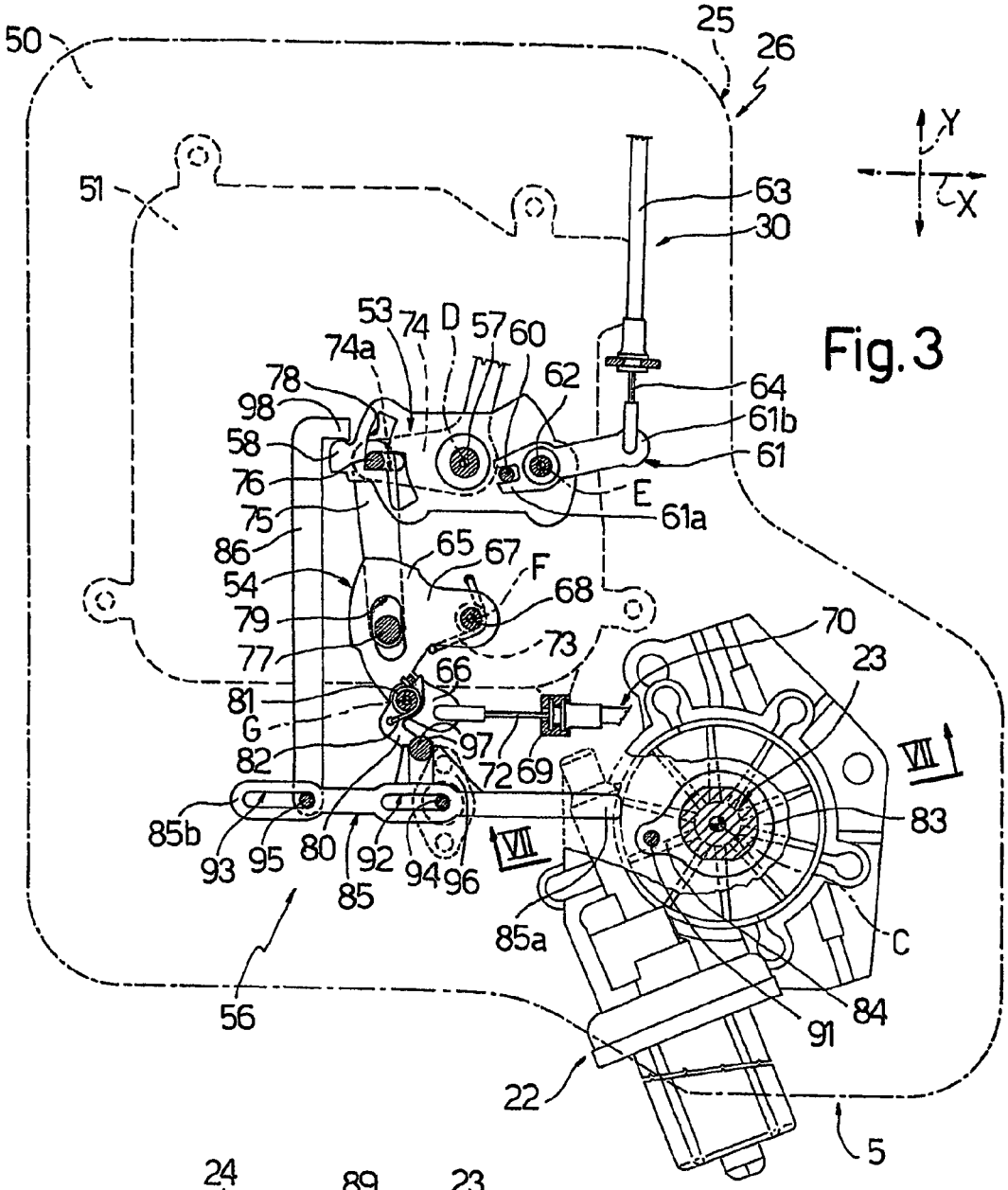
FIGS. 3 to 6 are elevations, at an enlarged scale and with parts removed for reasons of clarity, of a control module for the functional unit of FIG. 1, in different operating conditions.
Figure 4:
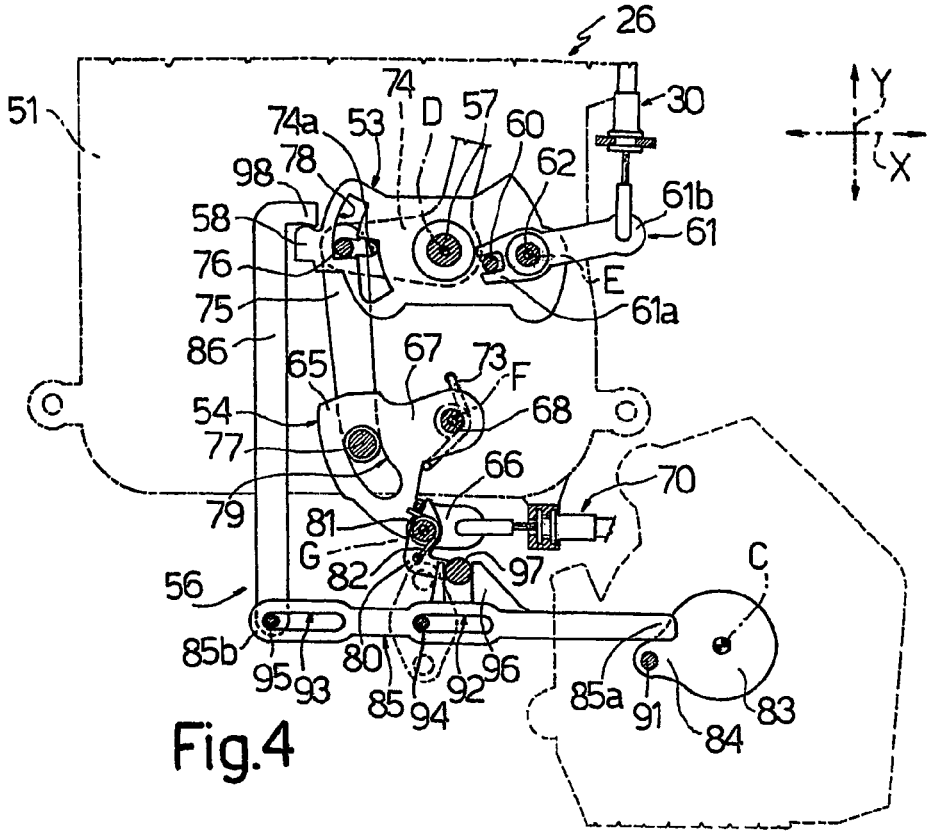

The opening lever 53 is maintained by a helical spring of a conventional type (not illustrated), which is wound around the pin, in a resting position, illustrated in FIGS. 3 and 4, in which it extends parallel to a direction X contained in the plane of the plate element 50, and can be displaced, against the action of the spring 73 and as a result of the activation of the transmission lever mechanism 56, in an opening position (see FIGS. 5 and 6), in which it is inclined with respect to the direction X and, by means of the transmission 30, brings about uncoupling of the dog 36 from the fork 35 and opening of the door 2.

The opening lever 53 has, at one end thereof, a projection 58 designed to receive opening forces from the transmission lever mechanism 56, and, on the opposite part of the pin 57 with respect to the projection 58, is provided with a pin 60 orthogonal thereto, which is engaged at one fork-like end 61*a* of a rocker-type lever 61, the opposite end 61*b* of which is constrained to the transmission 30.

More precisely, the lever 61 extends on a plane parallel to the plane of lie of the opening lever 53 and is hinged in an intermediate position to a pin 62, which is fixed to the box-type element 51 and has an axis E parallel to the axes C and D.

As may be seen in particular in FIGS. 1, 3, 4, 5 and 6, the transmission 30 is formed, in a known way, by a sheath 63, which has opposite ends fixed to respective appendages of the plate element 50 and of the supporting body 27, and by a cable 64, which is mounted so that it can slide axially within the sheath 63 and is constrained in an area corresponding to its own ends, one of which is opposite to the end 61*b* of the lever 61 and the other is opposite to the projection 47 of the actuating arm 46 of the dog 36. In the case in point, the sheath 63 traverses in a fluid-tight way (not illustrated), the diaphragm 14 of the compartment 11 of the door 2.

The control lever 54 has basically a C-shaped plane conformation and is set on one side of the opening lever 53 and in a position set between the latter and the actuator 22 of the window-regulator device 5.

The control lever 54 comprises a main portion 65 and a pair of arms 66, 67 extending in cantilever fashion from the same side as the main portion 65 itself. One of the arms (66) is hinged, in an area corresponding to a free end thereof, to a pin 68, which is fixed to the box-type element 51 and has an axis F parallel to the axes C, D, E; the other arm (67) projects on the outside of the box-type element 51 and is constrained to the handle 55 of the door 2 by means of a transmission 70 with Bowden-type flexible cable, altogether similar to the transmission 30.

In particular, the transmission 70 comprises, in a known way, a sheath 71 having opposite ends, one fixed to an appendage 69 of the plate element 50 and the other fixed to a supporting body 59 of the handle 55, and a cable 72, which is mounted so that it can axially slide within the sheath 71 and is constrained, in an area corresponding to its ends, one of which is opposite to the arm 67 of the control lever 54 and the other to the handle 55.

The control lever 54 is maintained by a helical spring 73 of a conventional type, which is wound around the pin 68, in a resting position, illustrated in FIG. 3, in which it is set with the arm 66 parallel to the direction X and maintains, by means of the arm 67, the cable 72 in a configuration of maximum extraction from the end of the sheath 71 adjacent to the appendage 69.

The control lever 24 can move, against the action of the spring 73 and as a result of the actuation of the handle 55, from the resting position of FIG. 3 to a first operative position (see FIG. 4) for bringing about, as will be explained in greater detail in what follows, activation of the transmission lever mechanism 56.

In order to enable emergency mechanical manoeuvres, the control lever 54 is moreover constrained to the opening lever 53 by means of a connection element 75 carrying at its opposite ends respective pins 76, 77 slidably engaged within respective slots 78, 79 of the levers 53, 54 themselves.

In practice, the slots 78, 79 are sized in such a way that the action of transmission of the connection element 75 is inhibited both during rotation of the control lever 54 between the resting position and the first operative position and during actuation of the transmission lever mechanism 56 by the actuator 22 of the window-regulator device 5, as will be clarified in greater detail in what follows.

In particular, the slots 78, 79 are both elongated in a direction transverse to the direction X and are obtained, respectively, in a position adjacent to the projection 58, in the case of the opening lever 53, and along the main portion 65, in the case of the control lever 54.

The slot 79 has a linear conformation, whilst the slot 78 is constituted by two consecutive linear stretches joined together by a step-like intermediate stretch.

As may be seen in FIG. 3, in the resting position of the opening lever 53 and of the control lever 54, the pin 77 occupies an intermediate position within the slot 79, whilst the pin 76 is positioned within the step-like intermediate stretch of the slot 78 and co-operates bearing upon the downstream end edge of the upstream linear stretch of the slot 78 itself with reference to the direction of rotation of the opening lever 53 designed to produce uncoupling of the dog 36 from the fork 35 (couterclockwise direction in FIGS. 3 to 6).

The position of the connection element 75 with respect to the opening lever 53 and the control lever 54 is maintained by means of a further lever 74 (illustrated only partially in FIGS. 3 to 6), which is hinged to the pin 68 and has, in a position spaced from the pin 68 itself, a slot 74*a*, which is elongated in a direction transverse to the direction of maximum extension of the slots 78, 79 and is engaged by the pin 76.

Figure 6:
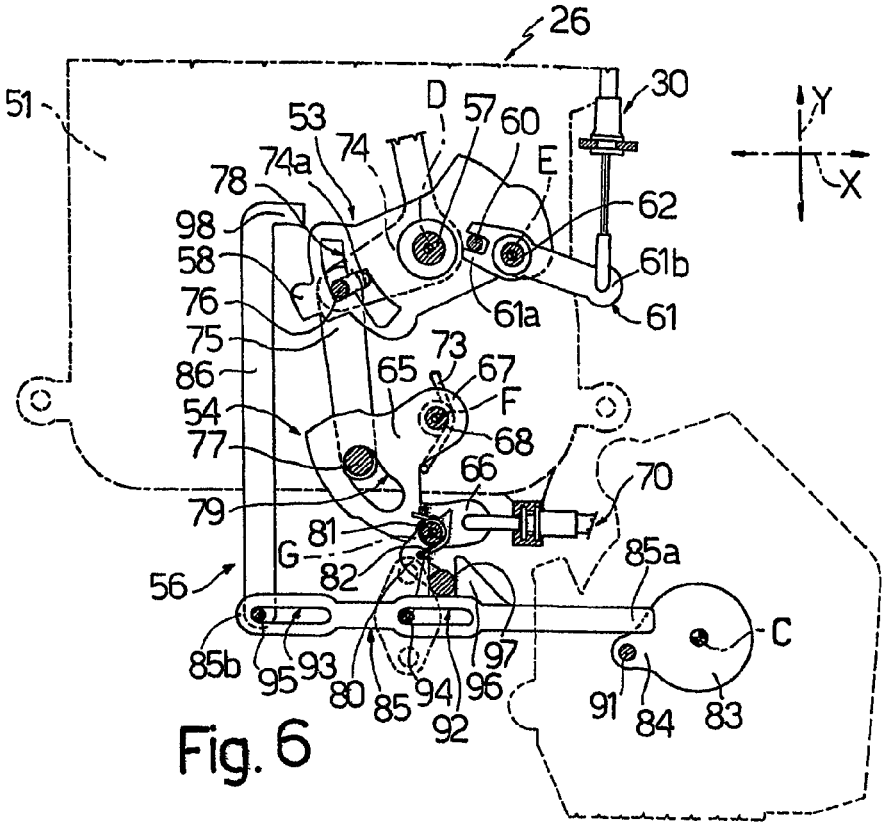

As will be highlighted in greater detail in what follows, actuation of the opening lever 53 via the connection element 75 can be obtained, only in the case of the actuator 22 failing to operate, by an overtravel of the handle 55 and, hence, of the control lever 54 from the first operative position to a second operative position (see FIG. 6).

The downstream linear stretch of the slot 78 is engaged by the pin 76 following upon a displacement imparted upon the connection element 75 by a safety mechanism (in itself known and not illustrated in so far as it is not necessary for an understanding of the present invention) in order to disable actuation of the opening lever 53 via the connection element 75 itself.

The control lever 54 is moreover provided with a further arm 80 extending in cantilever fashion from the arm 67 and designed to co-operate with the transmission lever mechanism 56 for bringing about activation in response to an actuation of the handle 55.

In particular, the arm 80 is hinged, at one of its ends, to the arm 67 by means of a pin 81 having an axis G parallel to the axes C, D, E, F and is elastically loaded by a cylindrical helical spring 82 wound around the pin 81 itself. More precisely, the spring 82 has one end fixed to the arm 80 and an opposite end which co-operates with a projection of the arm 67.

Advantageously, the spring 82 has an elastic stiffness considerably higher than that of the spring 73 so as to ensure a substantially rigid behaviour of the arm 80 with the remaining part of the control lever 54 during the step of activation of the transmission lever mechanism 56, and so as to undergo elastic deformation only during the overtravel of the control lever 54 itself.

With reference to FIGS. 3 to 7, the transmission lever mechanism 56 comprises a control disk 83 fitted on the shaft 23 of the actuator 22 and provided with an arm 84 for radial thrust, a selection lever 85 slidably supported by the plate element 50 in such a way that it can slide in the direction X between an advanced position (see FIGS. 4 and 6) for interaction with the arm 84 of the control disk 83 and a retracted position (see FIG. 3) of detachment from the arm 85 itself, and an actuating lever 86 for operation of the opening lever 53, constrained to the selection lever 85.

In practice, the selection lever 85 defines, in its retracted and advanced positions, two different configurations of the transmission lever mechanism 56, respectively for disabling and enabling control of the actuating mechanism 21 by the actuator 22.

In particular, as may be seen in FIG. 7, the actuator 22 is fixed to the plate element 50 by interposition of a spacer 87 in order to create, between the actuator 22 itself and the plate element 50, a space sufficient for housing the control disk 83 of the transmission lever mechanism 56.

In the case in point illustrated, the shaft 23 is formed by two grooved hubs 88, 89 set on opposite sides of the plate element 50 and angularly coupled together by a bushing 90, which engages in a fluid-tight way the hole 52 of the plate element 50. The hub 88 defines the output member of the actuator 22, whilst the hub 89 carries the roller 24 for winding of the cable for raising and lowering the window 7. The control disk 83 is fitted on one end of the bushing 90 adjacent to the actuator 22 and is designed to co-operate by thrust with the selection lever 85 through a pin 91 projecting in cantilever fashion from its own arm 84 in a direction parallel to the axes C, D, E, F, G.

The selection lever 85 has an elongated conformation, is designed to receive thrust forces from the control disk 83 in an area corresponding to one end 85*a* thereof, and is provided, in an intermediate position and in an area corresponding to its end 85*b* opposite to the end 85*a* itself, with corresponding slots 92, 93, which have identical conformation and are engaged respectively by a pin 94 fixed to the plate element 50 and by a pin 95 fixed to the actuating lever 86.

In the retracted and advanced positions and during displacements between the aforesaid positions, the selection lever 85 and the its slots 92 and 93 extend parallel to the direction X.

In particular, the end edges of the slot 92 define, bearing upon the pin 94, the retracted and advanced positions of the selection lever 85.

As is illustrated in FIG. 4, in the advanced position, the selection lever 85 is set with its end 85*a* along the path of rotation of the arm 84 of the control disk 83 about the axis C so as to be intercepted by the arm 84 itself.

The selection lever 85 is provided with a fork-like side projection 96 engaged by an end pin 97 of the arm 80 of the control lever 54. As a result of this constraint, a rotation of the control lever 54 about the axis F against the action of the spring 73 causes a displacement of the selection lever 85 from the retracted position to the advanced position, whilst an opposite rotation causes return of the selection lever 85 itself to the retracted position.

The actuating lever 86 has an elongated conformation and extends parallel to a direction Y orthogonal to the direction X and parallel to the plate element 50. The actuating lever 86 is in part housed within the box-type element 51 and in part projects therefrom.

The actuating lever 86 is provided, in an area corresponding to one of its ends, with the pin 95 for coupling with the slot 93 of the selection lever 85, and has, in an area corresponding to an opposite end 98, an L shape so as to act on the projection 58 of the opening lever 53 and pull it in the direction of opening of the lock 3, i.e., towards the selection lever 85 itself.

As a result of the rotation of the control disk 83 about the axis C, the selection lever 85, when set in the advanced position, is rotated by a pre-determined angle about the fixed pin 94 until a final operative position is reached, in which disengagement of the arm 80 from its end 85*a* takes place. During said rotation, the selection lever 85 exerts a pulling action on the actuating lever 86, increasing extraction thereof from the box-type element 51 and bringing about rotation of the opening lever 53 about the pin 57 in the direction of opening of the lock 3.

Activation/de-activation of the actuator 22 to obtain the function of electrical opening of the lock 3 is controlled by a pair of microswitches 99, 100 (of a known type and indicated schematically in FIG. 1) arranged along the paths of travel of the selection lever 85 and of the fork 35, respectively. In particular, the microswitch 99 switches when the forward position is reached by the selection lever 85 and issues an activation command to the actuator 22. Given the angularly rigid coupling between the hubs 88 and 89 of the shaft 23, activation of the actuator 22 for controlling opening of the lock 3 simultaneously causes a slight lowering of the window 7. This lowering is extremely advantageous in particular on convertibles, in so far as it prevents, during opening of the doors, overloading and deformation of the water-tight gaskets of the doors themselves.

The microswitch 100 signals the condition of door 2 open and switches when the closing position is reached by the fork 35, issuing to the actuator 22 a command for bringing back the hubs 88 and 89 of the shaft 23 into the initial angular position, and the window 7 into the position of closing of the window opening of the top portion 6 of the door 2.

In use, closing of the lock 3 can be obtained, in a conventional way, by simple slamming of the door 2. The result of this manoeuvre is an impact between the lock striker 4 and the tooth 42 of the fork 35, with consequent rotation of the fork 35 itself about the axis A towards the closing position against the action of the spring 43. As soon as the aforesaid closing position is reached (see FIG. 8), the engagement portion 44 of the dog 36 engages via snap-action with a corresponding shoulder of the fork 35, blocking the fork 35 itself in this position; consequently, the lock striker 4 is enclosed within the seat 34 of the fork 35.

Opening of the lock 3 from outside the motor vehicle is obtained by acting on the handle 55, and hence, via the transmission 70, on the control lever 54. In particular, as a result of the displacement of the handle 55, there is exerted a pulling action on the cable 72 of the transmission 70 with consequent rotation in a couterclockwise direction of the control lever 54 about the axis F starting from the resting position of FIG. 3.

During said rotation, the arm 80 exerts, with its pin 97, an action of thrust in the direction X on the fork-like projection 96 of the selection lever 85, displacing it from the retracted position to the advanced position of FIG. 4; moreover, the slot 79 slides with respect to the pin 77 of the connection element 75 until it comes to bear upon it with its end edge facing the opening lever 53.

Translation of the selection lever 85 is guided by sliding of the slots 92 and 93 on the corresponding pins 94, 95.

Thanks to the higher elastic stiffness of the spring 82 with respect to the spring 73, the arm 80 rotates integrally with the remaining part of the control lever 54.

As soon as the selection lever 85 reaches the advanced position, defined by the arrest between the pin 94 and the end edge of the slot 92 adjacent to the slot 93, the microswitch 99 switches, so causing activation of the actuator 22.

At this point (see FIG. 5), the shaft 23 rotates by a predetermined angle about the axis C bringing the pin 91 of the arm 84 of the control disk 83 to co-operate with the end 85*b* of the selection lever 85, which is rotated about the pin 94.

The above rotation produces, as a result of the interaction between the pin 95 and the side edge of the slot 93, a pull on the actuating lever 86, which translates parallel to the direction Y.

Figure 5:
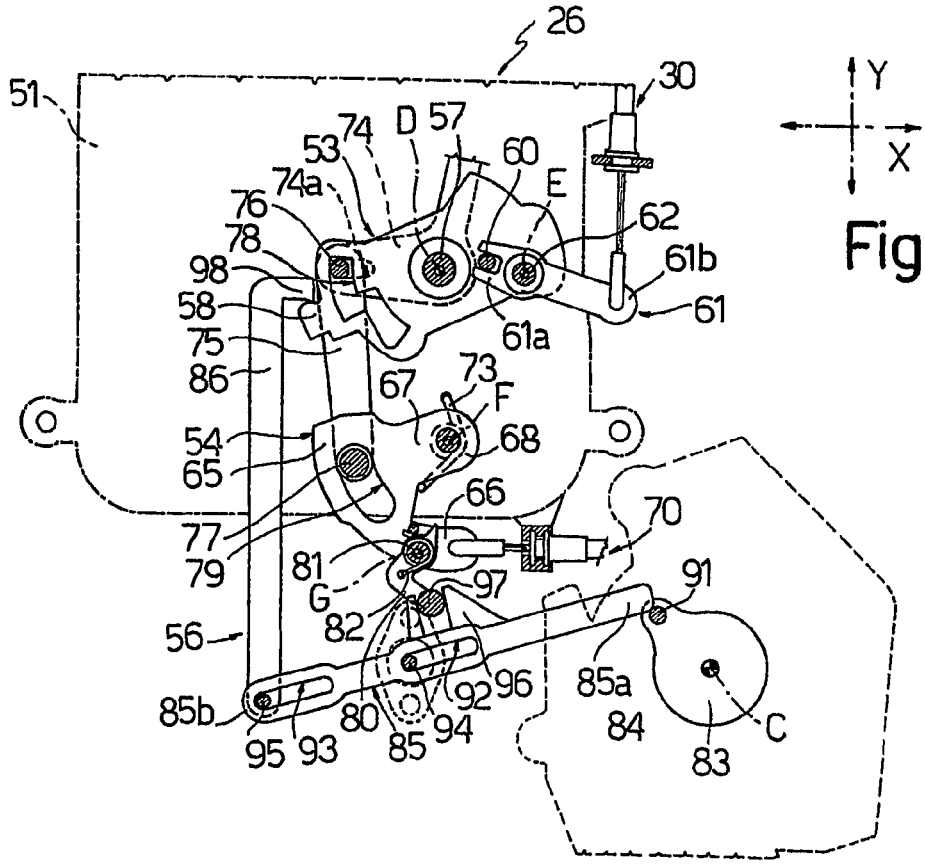

The actuating lever 86 exerts, with its L-shaped end 98, an action of thrust on the projection 58 of the opening lever 53, which is thus drawn in rotation about the axis D in a couterclockwise direction with reference to FIG. 5, until the opening position (see FIG. 5) is reached.

The couterclockwise angular displacement of the opening lever 53 about the axis D causes rotation in a clockwise direction of the lever 61 about the axis E, with a consequent pulling action on the cable 64 of the transmission 30 and release of the dog 36 from the fork 35, which can thus rotate towards the opening position under the thrust of the spring 43, so freeing the lock striker 4.

As soon as the handle 55 is released and the arm 84 of the control disk 83 disengages from the end 85*b* of the selection lever 85, the spring acting on the opening lever 53 and the spring 73 acting on the control lever 54 bring the levers 53, 54 themselves into the respective resting positions.

Thanks to the interaction between the projection 58 of the opening lever 53 and the L-shaped end 98 of the actuating lever 86, the latter is drawn by the opening lever 53 itself in the direction Y towards the inside of the box-type element 51 so as to bring back the selection lever 85 into a position parallel to the direction X.

Simultaneously, during its rotation towards the resting position, the control lever 54 pushes the selection lever 85 into the resting position of FIG. 3.

Rotation of the shaft 23 about the axis C brings about, moreover, through the action of drawing imparted by the roller 24 on the cable for raising and lowering the window 7, a slight lowering of the latter.

The subsequent closing of the door 2, with switching of the microswitch 100, generates a new activation command for the actuator 22 for bringing back the shaft 23 into the initial angular position and the window 7 into the position of closing of the window opening of the top portion 6 of the door 2 itself.

In the case of the electrical wiring system of the motor vehicle failing to operate or in the case of the actuator 22 not being activated, opening of the lock 3 can be obtained by acting further on the handle 55 so as to rotate the control lever 54 from the first operative position of FIG. 4 to the second operative position of FIG. 6. As a result of this action, a further pull is produced on the cable 72 of the transmission 70 and, whilst the arm 80 of the control lever 54 remains stationary, prevented from moving in so far as it is connected to the selection lever 85, which, in turn, cannot be further displaced towards the control disk 83 on account of the action of arrest exerted by the pin 94, the remaining part of the control lever 54 itself rotates about the axis F in a couterclockwise direction and, via the connection element 75, draws in rotation the opening lever 53 in the same direction, bringing about uncoupling of the dog 36 from the fork 35.

Figure 9:
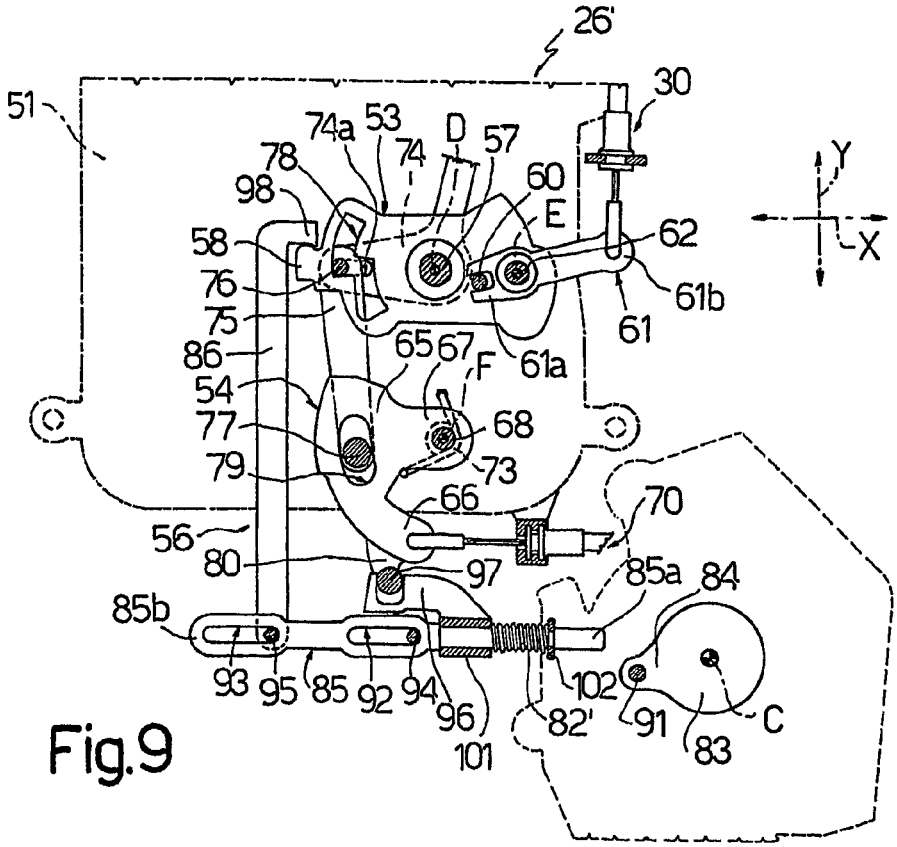
FIG. 9 is similar to FIG. 3 and illustrates a different embodiment of a detail of the control module of FIG. 3 itself.

In FIG. 9, designated as a whole by 26' is a different embodiment of a control module for the functional unit 1. The control module 26' is described only as regards what differs from the control module 26, designating by the same reference numbers parts that are the same as or correspond to the ones already described.

In particular, the control module 26' differs from the control module 26 in that the arm 80 is fixed to the remaining part of the control lever 54, and in that the fork-like projection 96 is made on a sleeve 101 slidably mounted on the selection lever 85 and elastically loaded by a cylindrical helical spring 82', having the same function as that of the spring 82. More precisely, the spring 82' is set between the sleeve 101 and a ring 102 fixed rigidly to the outer surface of the selection lever 85 in the proximity of the end 85*b*.

The spring 82' has an elastic stiffness sufficiently high to enable rigid displacement of the sleeve 101 and of the fork-like projection 96 with the selection lever 85 during displacement of the latter between the retracted position and the advanced position as a result of the thrust exerted by the control lever 54 in the rotation between the resting position and the first operative position.

The control lever 54 can be displaced from the first operative position to the second operative position with sliding of the sleeve 101 on the selection lever 85, prevented from moving further from the advanced position towards the actuator 22 on account of the action of arrest exerted by the pin 94.

From an examination of the characteristics of the functional unit 1 made according to the present invention, the advantages that this enables are evident.

In particular, by exploiting the actuator 22 for control of the window-regulator device 5 and simply adding a transmission lever mechanism 56 with selective activation which connects the actuator 22 itself to the actuating mechanism 21, it is possible to provide also the function of electrical opening of the lock 3. This enables a reduction in the overall number of electrical actuators present on the lock 3, which is therefore particularly simple and economically advantageous and of contained overall dimensions and weight.

Finally, it is clear that modifications and variations may be made to the functional unit 1 described and illustrated herein, without thereby departing from the sphere of protection of the present invention.

In particular, according to a possible variant (not illustrated), the selection lever 85 could be replaced by a transmission belt wound in a slack way around a drive pulley fixed to the shaft 23 and around a driven pulley supported by the plate element 50 and provided fixedly with a radial arm, constrained, at one free end thereof, to the actuating lever 86. In this case, the arm 80 of the control lever 54 could be provided with a belt-tensioner roller, designed to operate as tensioner, following upon displacement of the control lever 54 into the first operative position so as to enable transmission of motion from the drive pulley to the driven pulley. The angular displacement of the driven pulley, obtained following upon activation of the actuator 22, could thus bring about, through its radial arm, a translation correlated to the actuating lever 86.

According to a further variant (not illustrated), the selection lever 85 could be provided, at one end opposite to the end connected to the actuating lever 86, with a gear with front teeth, which, in turn, can be selectively coupled to another gear with front teeth carried by a member angularly connected to the shaft 23.

The invention claimed is:

1. A combination of a functional unit (1) and a door (2) for a motor vehicle, wherein the door includes a window, wherein the functional unit includes a lock, an actuating mechanism and a window regulator device, the lock (3) comprising a closing mechanism (20) that, in use, releasably couples with a lock striker (4) bringing about closing of said door (2);

wherein the actuating mechanism (21) controls release of said closing mechanism (20) by said lock striker (4) to bring about opening of said door (2), wherein the actuating mechanism (21) includes a control member (54) that, in use, is connected to a handle (55) of said door (2) and is selectively displaced from a resting position to a first operative position which brings about said transmission assembly (56) from said disabling configuration to said enabling configuration, wherein the actuating mechanism (21) further includes an opening lever (53), which is connected to said closing mechanism (20) and can be displaced, by means of said transmission assembly (56), from a resting position to an opening position, in which the opening lever brings about release of said closing mechanism (20) from said lock striker (4); a connection element (75) for connecting selectively together said opening lever (53) and said control member (54); and constraint means (76, 77, 78, 79), which are set between said connection element (75), said opening lever (53) and said control member (54), and are active during an overtravel of the control member (54) for enabling emergency opening of said door (2), the window-regulator device (5) comprising an electrically operated actuator (22) that, in use, raises and lowers a window (7) of said door (2), said functional unit further comprising coupling means (56), which selectively couples together said actuator (22) and said actuating mechanism (21 enabling, in use, opening of said door (2) by means of the actuator (22), wherein the coupling means comprises a transmission assembly (56) set between said actuator (22) and said actuating mechanism (21) and selectively available in two operating configurations corresponding to enabling and disabling control of said actuating mechanism (21) by said actuator (22).

2. The unit according to claim 1, characterized in that said actuator (22) has an output shaft (23), which can turn about an axis (C) thereof to operate a member (24) for raising and lowering a window (7) of said door (2), and in that said transmission assembly (56) comprises a motor member (83) angularly coupled to said shaft (23), and a selection member (85) available in a first advanced position, in which the selection member is designed to receive actuation from said motor member (83), and a second operative position, in which the selection member is uncoupled from the motor member (83).

3. The unit according to claim 1, characterized in that said constraint means comprise respective slots (78, 79) made on said opening lever and on said control member (53, 54) and engaged with play by respective pins (76, 77) of said connection element (75).

4. The unit according to claim 3, characterized in that said first and second operative positions of said selection member (85) are defined by the interaction of the selection member (85) with fixed arrest means (94), in that said selection and control members (85, 54) co-operate together with respective interaction portions (96, 80), and in that at least one of said interaction portions (96, 80) is constrained in a mobile way to the remaining part of the said corresponding member (85, 54) and is loaded by deformable elastic means (82, 82') until said first operative position is reached by said selection member (85) in order to enable an overtravel of said control member (54), along which the control member actuates said opening lever (53) via said connection element (75).

5. The unit according to claim 1, characterized in that said first and second operative positions of said selection member (85) are defined by the interaction of the selection member (85) with fixed arrest means (94), in that said selection and control members (85, 54) co-operate together with respective interaction portions (96, 80), and in that at least one of said interaction portions (96, 80) is constrained in a mobile way to the remaining part of the said corresponding member (85, 54) and is loaded by deformable elastic means (82, 82') until said first operative position is reached by said selection member (85) in order to enable an overtravel of said control member (54), along which the control member actuates said opening lever (53) via said connection element (75).

* * * * *